US005347905A

United States Patent [19]

Cipriani

[11] Patent Number: 5,347,905

[45] Date of Patent: Sep. 20, 1994

[54] ADJUSTABLE BRIDGE SYSTEM FOR ACOUSTICAL STRINGED INSTRUMENTS

[76] Inventor: Thomas J. Cipriani, 2019 Jackson St., Hollywood, Fla. 33020

[21] Appl. No.: 751,074

[22] Filed: Aug. 28, 1991

Related U.S. Application Data

[63] Continuation-in-part of Ser. No. 496,794, Mar. 21, 1990, Pat. No. 5,052,260, and a continuation-in-part of Ser. No. 446,215, Dec. 5, 1989, Pat. No. 5,092,213, which is a continuation-in-part of Ser. No. 213,157, Jun. 29, 1988, Pat. No. 4,951,543, which is a continuation-in-part of Ser. No. 39,941, Apr. 20, 1987, abandoned.

[51] Int. Cl.[5] ..... G10D 3/04

[52] U.S. Cl. ..... 84/298; 84/731

[58] Field of Search ..... 84/298, 299, 307, 308, 84/309, 731

[56] References Cited

U.S. PATENT DOCUMENTS

| | | | |
|---|---|---|---|
| D. 259,119 | 5/1981 | Quan | 84/298 |
| 2,491,788 | 12/1949 | Widowson | 84/298 |
| 3,453,920 | 7/1969 | Scherer | 84/731 |
| 4,366,740 | 1/1983 | Tripp | 84/298 |
| 4,538,498 | 9/1985 | Marten | 84/298 |
| 4,768,414 | 9/1988 | Wheelwright | 84/298 |
| 4,911,057 | 3/1990 | Fishman | 84/731 |
| 4,951,543 | 8/1990 | Cipriani | 84/298 |
| 5,052,260 | 10/1991 | Cipriani | 84/298 |
| 5,092,213 | 3/1992 | Cipriani | 84/299 |

*Primary Examiner*—Michael L. Gellner
*Assistant Examiner*—Cassandra Spyrou
*Attorney, Agent, or Firm*—Ladas & Parry

[57] ABSTRACT

A bridge assembly for a guitar mounted on a soundboard cover of a resonating box, the bridge assembly comprising a bridge fixed on the soundboard cover, a block-like platform secured to the bridge and transversely spaced saddles on which the guitar strings pass under tension. The strings contact the saddles at points of support and establish vibration lengths of the strings. The strings undergo change of angle at their points of support to apply force along a line of action passing through the platform to the soundboard cover and the resonating box. The saddles are connected to the platform for adjustment longitudinally of the strings to vary the vibration length of the strings and thereby effect string length fine tuning. At the end positions of adjustment of the saddles, and for all positions therebetween, forces applied by the strings will be directed to pass to the soundboard cover either directly through the platform or through a thin portion of the bridge on which the platform rests. The force acts in a direction substantially perpendicular to the upper surface of the thin portion of the bridge. A transducer can be interposed between each saddle and the platform and resiliently clamped therebetween.

27 Claims, 9 Drawing Sheets

ADJUSTABLE BRIDGE SYSTEM FOR ACOUSTICAL STRINGED INSTRUMENTS

CROSS RELATED APPLICATIONS

This application is a continuation-in-part of Ser. No. 496,794 filed Mar. 21, 1990 and of Ser. No. 446,215 filed Dec. 5, 1989 now U.S. Pat. No. 5,092,213, the latter in turn being a continuation-in-part of Ser. No. 213,157 filed Jun. 29, 1988 now issued as U.S. Pat. No. 4,951,543 which in turn is a continuation-in-part of Ser. No. 039,941 filed Apr. 20, 1987 now abandoned.

BACKGROUND

In my earlier U.S. Pat. Nos. 4,911,055 and 4,951,543 and in co-pending application Ser. No. 446,215, I have disclosed a number of constructions of bridge systems for a guitar which increase volume and sustain of a vibrating string of the guitar. Also disclosed are bridge systems which have individual saddles supporting respective strings which can be independently adjusted longitudinally to effect string length fine tuning.

These constructions embody the principle of direction of transfer of the string forces to the soundboard via the saddle and to the principle of adjustability of the saddles so as not to diminish the optimum sound of a given instrument.

In further study I have found that by combining these two principles and incorporating them into a particular bridge system, a simple and practical embodiment can be obtained which can be installed as a retrofit or a new manufacture in a guitar and by which the saddles can be made adjustable and the volume and sustain are increased even further.

SUMMARY OF THE INVENTION

An object of the present invention is to provide a bridge system in which an assembly of saddles and a supporting platform is stabilized while providing transfer of increased string vibrational energy to the soundboard cover whereby the push force acting on the saddle from the associated string is transferred with minimum diminution to the soundboard cover thus creating increased volume and sustain.

A further object of the invention is to provide a bridge system in which the vibrational energy of each string is maintained separately and is individually directed to the soundboard cover with minimum loss.

Another object of the invention is to provide a bridge system in which the adjustability of the saddles is achieved in simple manner by the user of the musical instrument and the bridge assembly can be easily and rapidly replaced.

A further object of the invention is to provide a bridge assembly for an electrified acoustic stringed musical instrument, such as a guitar, in which electrical transducers are mounted by an adjustable resilient clamping force enabling transducing of the vibrational energy into electrical energy in the most efficient manner.

A further object of the invention is to provide an externally applied actuator, in the form of a portable unit, for effecting longitudinal adjustment of the saddles.

In order to achieve the above and further objects of the invention, the bridge assembly comprises a block-like platform member secured to a bridge member which is fixed with respect to the soundboard cover of the musical instrument, the platform member supporting a saddle on which a string passes under tension. The contact of the string with the saddle provides a point of support for the string establishing a vibration length of the string, the string undergoing change of angle at the point of contact to apply force thereat along a line of action passing through the platform to soundboard cover and the underlying resonating box of the musical instrument. The saddle is connected to the platform member for adjustment longitudinally of the string to vary the vibration length of the string and thereby effect string length fine tuning. The saddle is longitudinally adjusted between end positions at which, and for all positions therebetween, forces applied by the string to the bridge member will be directed to pass through the platform to the soundboard cover.

In one embodiment of the invention, the bridge member is formed with a thin portion which supports the platform member and the force of the string on the saddle is transmitted along a line of action directed substantially perpendicular to the upper surface of the thin portion of the bridge member.

In another embodiment, the platform member rests directly on the soundboard cover and the force of the string on the saddle acts through the platform onto the soundboard cover.

In the embodiment where the bridge member has a thin portion, I have found that in order to direct the force applied by the string to the saddle at a right angle to the upper surface of the thin portion of the bridge member, said upper surface should be inclined at an angle of one-half of the change of angle which the string undergoes at its point of support with the saddle.

In order to minimize weight of the platform member and provide effective transfer of vibrational energy from the individual strings to the soundboard cover, the lower portion of the platform member is provided with longitudinal openings in regions between adjacent, transversely spaced saddles. As a consequence, posts are formed between the openings which are disposed directly beneath the strings for efficient transmission of the forces from the strings to the soundboard cover with minimum interference between the forces on the respective saddles.

The invention also contemplates the formation of the platform member with a stepped surface to support selected saddles at different levels above the soundboard cover.

According to a further embodiment of the invention, the platform member includes a rear wall projecting upwardly and rearwards of the saddles so that the strings pass from the saddles onto the rear wall to make contact therewith at a second point of support at which the strings undergo change of angle and apply forces to the rear wall. The rear wall is so configured that the forces produced by the change of angle of the strings at the second point of support are directed below the platform member to the underlying soundboard cover.

In the embodiment of the bridge assembly for the electrified acoustic guitar, the transducers are interposed between each saddle and the platform member and the saddles are clampingly attached to the platform member through a resilient means which resiliently resists the clamping pressure of the saddles and the platform member on the transducers. The clamping attachment can be achieved by an adjustable clamping means which comprises a threaded connection between each saddle and the platform member, said resilient means comprising a resilient member in each threaded connection. According to a particular embodiment, the resilient member can be a Belleville washer.

DETAILED DESCRIPTION OF PREFERRED EMBODIMENTS OF THE INVENTION

Figure 1:
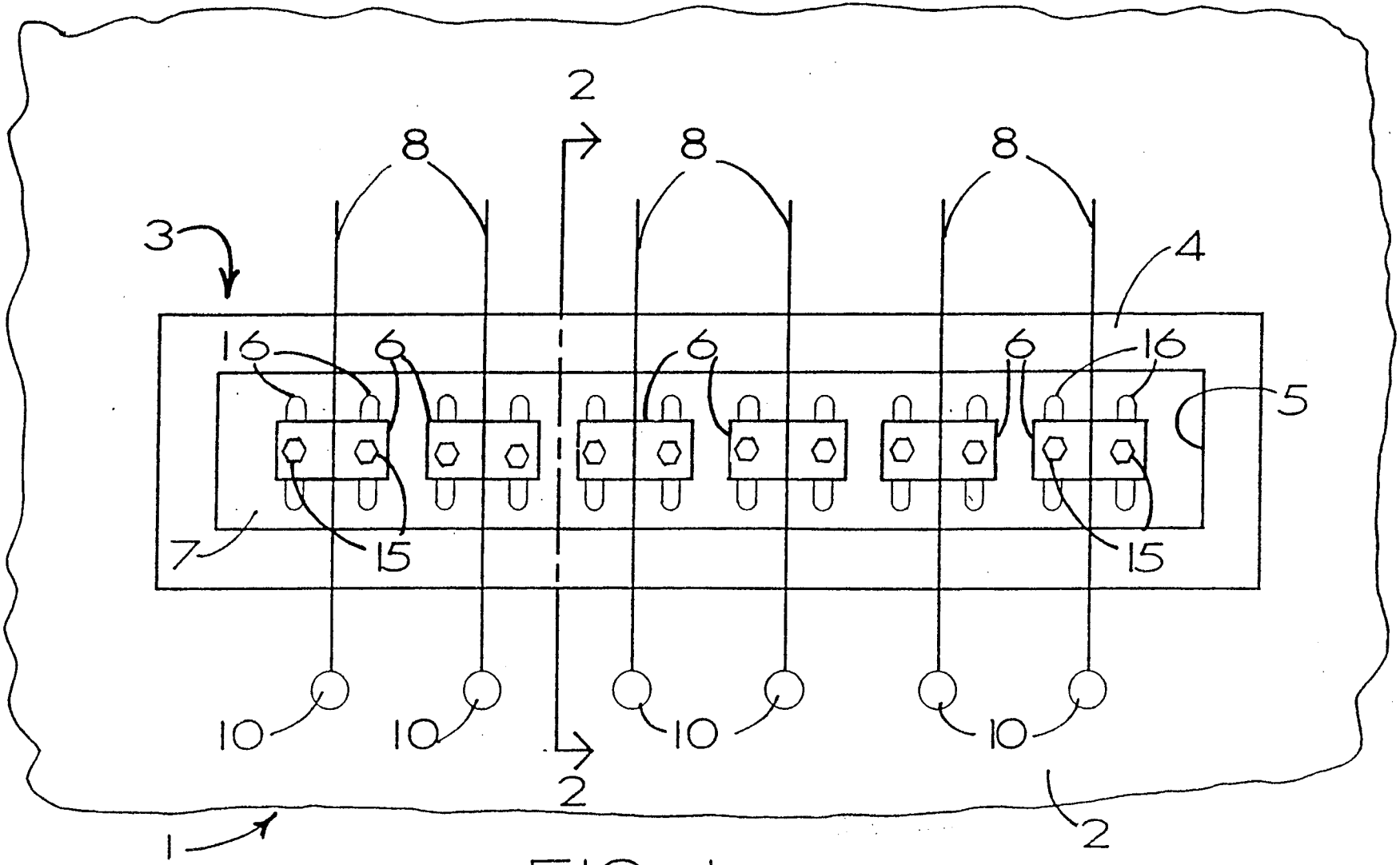
FIG. 1 is a top plan view of a portion of a stringed musical instrument showing a first embodiment of a bridge system according to the invention.

Referring to the drawings and especially to FIG. 1, there is shown a portion of a stringed musical instrument 1, particularly a guitar, having a soundboard cover 2 to which is affixed a bridge assembly 3 comprising a bridge 4 having a groove 5 in which is mounted a platform 7 supporting a plurality of saddles 6 in transversely spaced relation. Each saddle supports a respective string 8 of the guitar. Each string 8 has an anchor 9 at one end and the string is secured at this end to the bridge system by a bridge pin 10. There are many other ways of anchoring the string as will be known to those skilled in the art. The opposite end of the string is connected to a tuning peg (not shown). By turning the tuning peg, the tension in the string and the frequency of the string vibration can be adjusted. Each string 8 contacts its respective saddle at a point of support 11 which establishes the vibration length of the string. Each saddle 6 is adjustable on the platform 7 longitudinally of the string in order to vary the vibration length of the string and achieve string length fine tuning. The longitudinal adjustment of the saddles will be discussed in greater detail later.

At the contact point 11 of the string 8 with its associated saddle 7, the string undergoes a change of angle $\alpha$. The change of angle of the string at the contact point 11 on the saddle produces a force F acting on the saddle which is transmitted through the platform 7 to the bridge 4 and then to the soundboard cover 2 and the underlying resonating box of the guitar.

Figure 2:
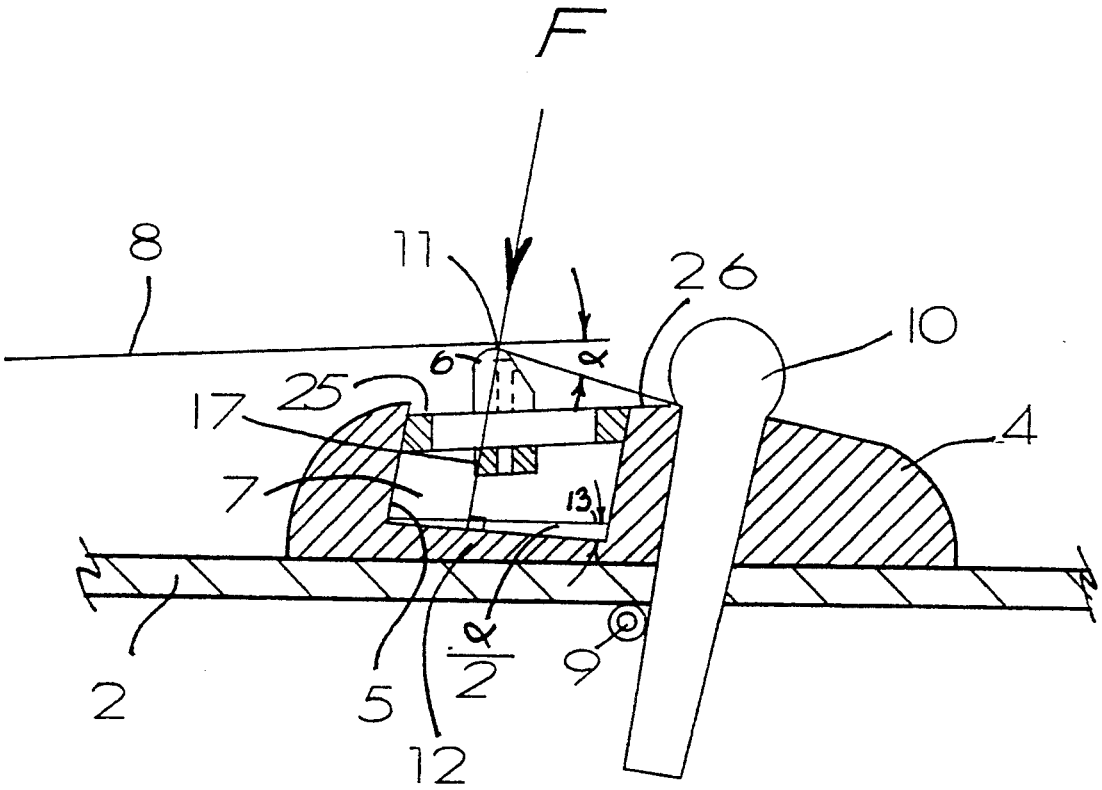
FIG. 2 is a sectional view taken along line 2—2 in FIG. 1.

In the embodiment illustrated in FIG. 2, the groove 5 in the bridge 4 leaves a relatively thin portion 12 in the bridge on which the platform 7 rests. It has been determined that by making the portion 12 of the bridge relatively thin, the vibrational energy transmitted from the string to the soundboard cover will be substantially undiminished. In this respect, the bridge 4 is usually made from a relatively soft material such as wood, which has the effect of damping the vibrational energy before it is transmitted to the soundboard cover 2. It has been further determined, in accordance with the present invention, that minimum loss of vibrational energy will be obtained if the force F acts on the upper surface 13 of the thin portion 12 at right angles to this surface. If the force acts at an inclined angle relative to the upper surface of thin portion 12, the longitudinal components of the force represent undesirable vibrational energy leading to distortion and normally must be damped by the bridge 4. In order for the force F to act perpendicularly to surface 13 of the thin portion 12 of the bridge, it has been found that the surface 13 should be inclined at an angle which is equal to one-half of the change of angle of the string at point 11, or in the case at hand, at an angle of $\alpha/2$. In general, the inclination of surface 13 relative to the bottom surface of the bridge 4 (and thereby the upper surface of the soundboard cover 2) is generally between 5 and 20 degrees. By virtue of the perpendicular arrangement of the force F on the upper surface of the thin portion 12 of the bridge, the vibrational energy is substantially transmitted in entirety to the soundboard cover 2 without dampening by the end walls and side walls of the bridge 4. In the embodiment shown in FIGS. 1 and 2, the front of the platform is shown in abutment all along the front wall of the bridge. However, this is not mandatory and an angular gap can be formed since no horizontal force is being transmitted between the platform and the bridge. The platform can be wrapped or encircled around its side end and walls with a layer of elastic material to tightly fit the platform in the groove of the bridge. Additionally, the corners of the platform can be rounded to assist in the installation of the platform in the bridge Each saddle 7 is longitudinally adjustable with respect to the strings 8 by engagement of bolts 5 in respective slots 16 in the platform. More specifically, each saddle 6 carries a pair of bolts 15 lying on opposite sides of the associated string and the bolts 15 extend through the slots 16 and are engaged with the respective nuts 17. When the bolts 15 are loosened, the saddles are movable longitudinally between end positions at which, and for all positions therebetween, the force F applied by the respective string to the associated saddle will be transmitted through the platform to and through the thin portion 12 of the bridge to the soundboard cover 2.

Figure 4:
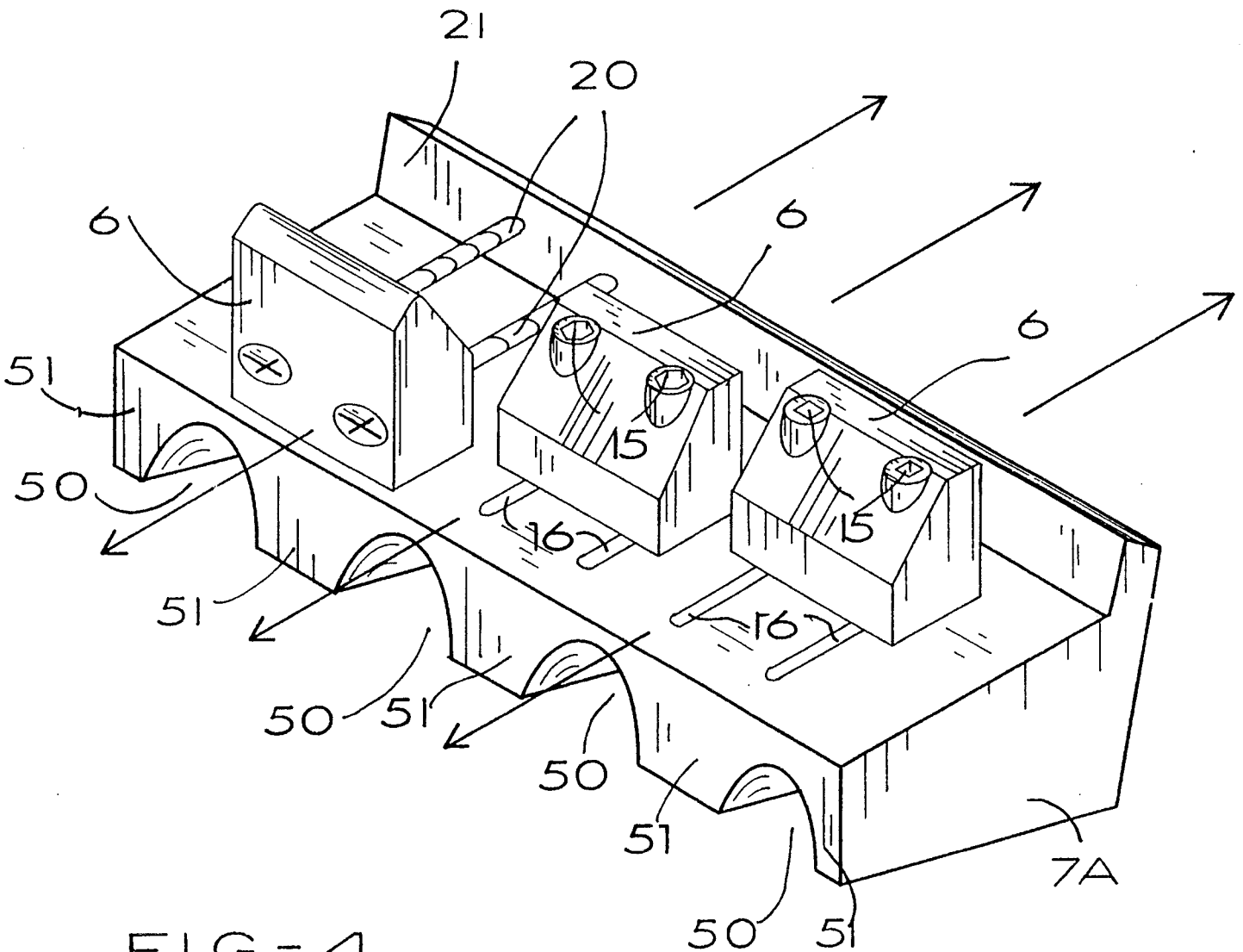
FIG. 4 is a perspective view, illustrating a portion of a modified bridge assembly of that shown in FIG. 1.
Figure 9:
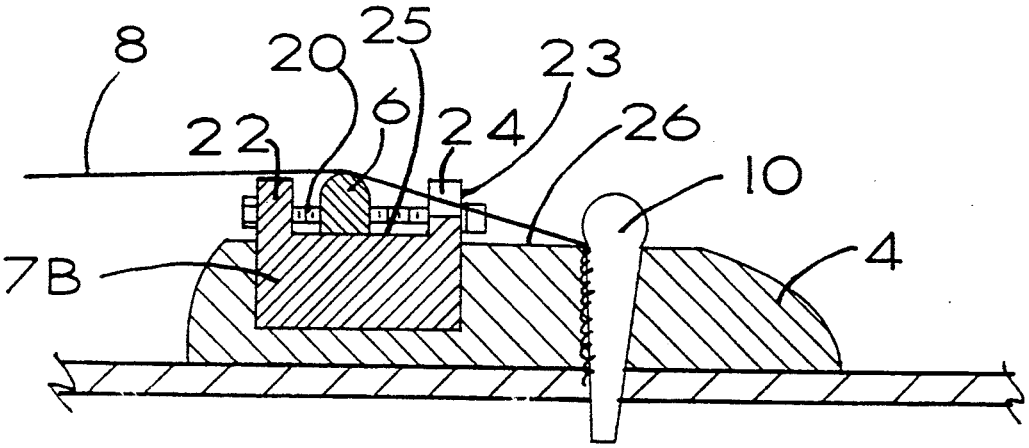
FIG. 9 is a longitudinal sectional view of the bridge assembly with a modified arrangement of the means for longitudinally adjusting the saddles of the bridge assembly.

In FIG. 4, the saddles 6 shown in the center and at the right are provided with the longitudinal adjustment means previously described, namely with the bolts 15 and the platform 7A is provided with slots 16 beneath which are nuts 17. The saddle 6 at the left end employs a modified construction of the longitudinal adjustment means and in this respect longitudinally arranged bolts 20 are threadably engaged in the saddle and are rotatable and axially fixed in a rear wall 21 of platform 7A. When the bolts 20 are rotated, the saddle will translate longitudinally in the directions shown by the arrows depending upon the direction of rotation of the bolts 20. FIG. 9 shows a modified arrangement of the longitudinal adjusting means for the saddle 6 and therein the platform 7B has a front wall 22 and a rear wall 23 rotatably supporting bolts 20. As in the previous embodiment, the bolts 20 are threadably engaged with the saddles 6 and upon rotation of the bolts 20 the saddle will be longitudinally displaced. The rear wall 23 is provided with a number of slits 24, one for each string 8, so that the string is engaged in the .slit and avoids contact with the rear wall 23 when traveling from the saddle 6 to the bridge pin 10.

Figure 3:
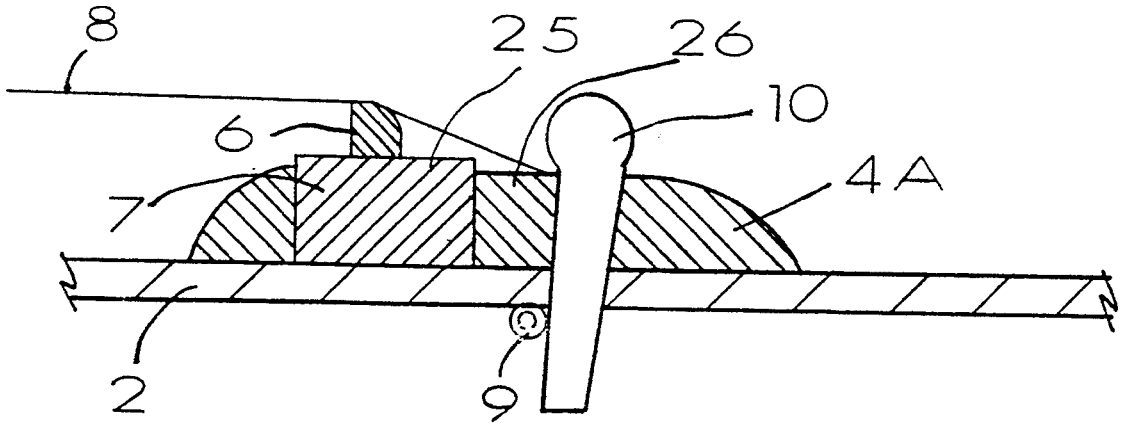
FIG. 3 is similar to FIG. 2 and illustrates a modified embodiment.

FIG. 3 shows a modified bridge 4A in which the relatively thin portion previously described has been eliminated. Namely, the groove 5 formed in the bridge extends completely through the bridge 4A so that the platform 7 rests directly on the upper surface of the soundboard cover 2 The platform 7 is tightly fitted in groove 5. The longitudinal adjustment of the saddles 6 relative to the platform 7 is effected in the same manner as previously described. Instead of directing the force applied by the string to the saddle in a perpendicular fashion relative to the upper surface of the thin portion of the saddle, the force is applied at a slight angle relative to the upper surface of the soundboard cover. However, due to the absence of the-thin portion of the bridge, the damping effect of the bridge is eliminated. The horizontal component of the vibrational energy directed at an angle $\alpha/2$ relative to the soundboard cover will be dissipated in the soundboard cover. This loss of energy is compensated by the absence of any damping intervention by the bridge 4.

In the embodiments shown in FIGS. 3 and 9, the upper surface 25 of the platform extends to a level above the upper surface 26 of the bridge. In the embodiment of FIG. 2, the upper surface 25 of the platform is slightly recessed relative to the upper surface 26 of the bridge. However, the top of the saddle 6 is disposed at a sufficiently high elevation above the upper surface of the platform so that it is located above the upper surface 26 of the bridge at a proper positioning for the string with respect to the fret board (not shown). The upper surface of the platform member extends generally parallel to the upper surface of the soundboard cover 2 so that when the saddles are longitudinally adjusted, the upper contact point 11 of the saddles will remain in a plane generally parallel to the existing string angle which in turn is related to the existing angle of the neck of the instrument.

In order for the platform and saddles to be structurally durable, they must be made of light but dense material that does not absorb vibration. Suitable materials are plastics, such as Corian and Delrin (products of DuPont), Micarta ( a product of Westinghouse ) bone, ivory, carbon fiber graphite optionally with boron additives, boron filament composites, Spectra and Spectra graphite composites.

Figure 5:
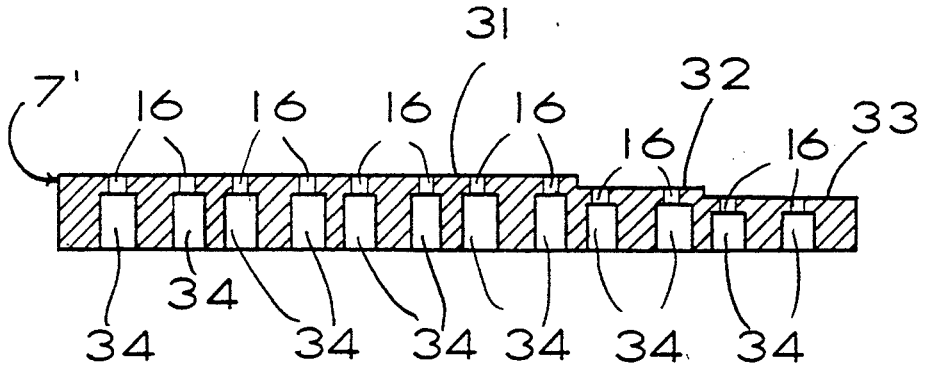
FIG. 5 is a transverse sectional view of an embodiment of a stepped platform of a bridge assembly.
Figure 6:
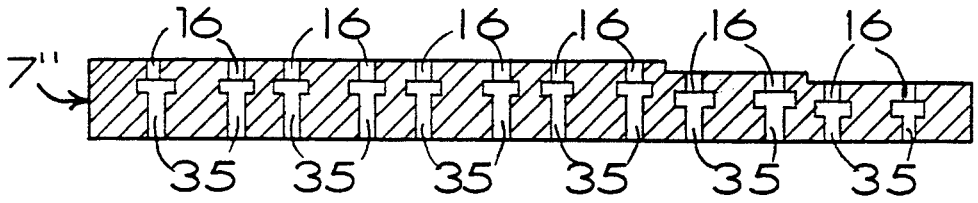
FIG. 6 shows a modified embodiment of the platform in FIG. 5.

FIG. 5 is a sectional view of a modified platform 7, which is stepped to provide three surfaces 31, 32 and 33 at different levels to alter the heights of selected strings above the fret board. In FIG. 5 there can be seen the pairs of slots 16 for each saddle and each slot 16 opens into a groove 34 in which the nuts 17 are received. FIG. 6 is similar to FIG. 5 except that instead of rectangular grooves 34, the grooves are formed as T-shaped grooves 35 in order for the nuts 17 to be retained in the horizontal branch of the T. In both embodiments, the nuts are supported in the grooves with capability of longitudinal displacement while being blocked against rotation.

Figure 8:
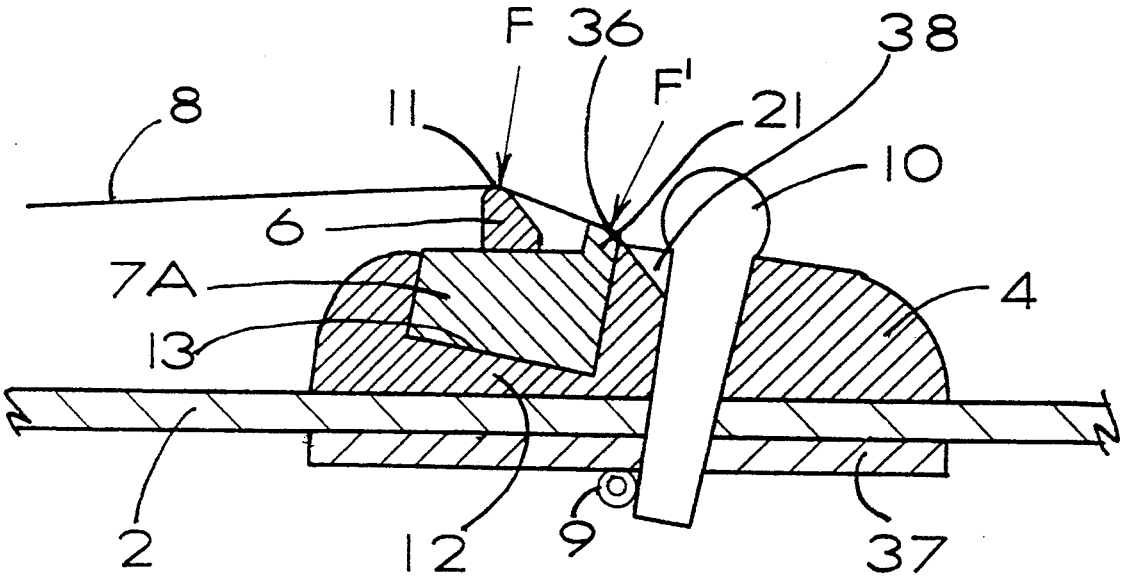
FIG. 8 is similar to FIG. 2 and illustrates another modified embodiment.

FIG. 8 shows another embodiment in which the string 8 undergoes contact with the rear wall 21 of the platform 7A before it is secured by the bridge pin 10. Consequently, the string undergoes change of angle at the support point 11 on the saddle 6, as before, and additionally, the string undergoes a second change of angle at a second support point 36 on the rear wall 21. Although it is preferred for the force F′ developed at the point of support 36 on the rear wall to be inclined substantially parallel to force F developed at support point 11, it is a necessary condition that the force F′ be directed along a line of action which will intersect the upper surface 13 of the thin portion 12 in order not to dissipate the vibrational energy at support point 36 into the thick portion of the bridge 4. Consequently, all of the vibrational energy as well as the forces developed at the support points will be transmitted through the platform 7A to the thin portion 12 of the bridge 4 and then to the soundboard cover 2. In FIG. 8, a reinforcing structure 37 is mounted beneath the soundboard cover 2 and the anchor 9 of the string is secured by the bridge pin 10 beneath the reinforcing structure 37. The bridge 4 is provided with a slot 38 so that the string 8 can pass from the support point 36 to the bridge pin without contacting the bridge 4.

Figure 7:
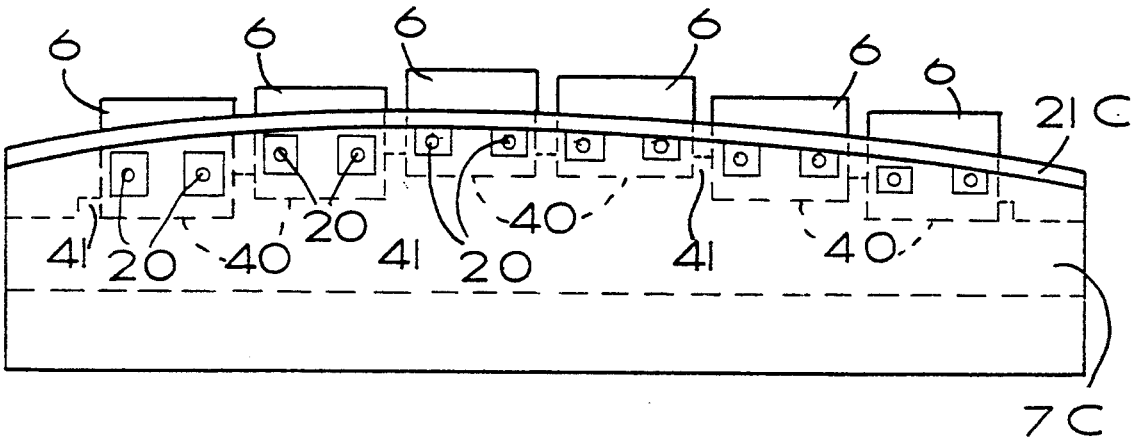
FIG. 7 is an end elevational view of the embodiment of the bridge assembly in FIG. 4.

FIG. 7 shows a modification of the platform in FIG. 8 and in FIG. 7 the platform 7C has individual steps for respectively supporting the saddles 6 at individual elevations. The saddle 7C has a curved rear wall 21C which is adapted to the elevation of the saddles 6 and to a curved fret board (not shown) associated therewith. Each saddle 6 rests on a respective support step 40 and longitudinal adjustment of the saddles is effected by the longitudinal adjustment means including bolts 20 as shown for the leftmost saddle 6 in FIG. 4. At the sides of the stepped surfaces 40 are longitudinal ridges 41 which laterally engage the sides of the saddles 6 to guide the travel of the saddles longitudinally and prevent turning or twisting thereof.

In order to ensure direct transfer to the soundboard cover 2 of the force and vibrational energy applied by the strings to the saddles without damping and without interference of the string energies with one another, the platform is provided as shown in FIG. 4 with a plurality of longitudinal openings 50 extending through the entire length of the platform. The openings 50 are semi-arcuate and are open at the bottom of the platform to define posts 51 between form. The bottom support surface of the platform is formed by the lower surfaces of the posts 51. Posts 51 are located directly beneath respective saddles 6 in the same longitudinal plane as the strings which contact the saddle. Thereby the forces applied by the strings to the saddles are directly transmitted through the posts 51 to the underlying support. In the same way, all of the vibrational energy from each string is transmitted through the associated saddle and the respective post 51 of the platform to the underlying structure. By isolating the forces and vibrational energy applied to the soundboard cover from the individual saddles, better timbre (tone) is produced. The arcuate shape of the openings 50 ensures the transmission of force and vibrational energy from the strings to the underlying structure through the saddles and posts.

Figure 10:
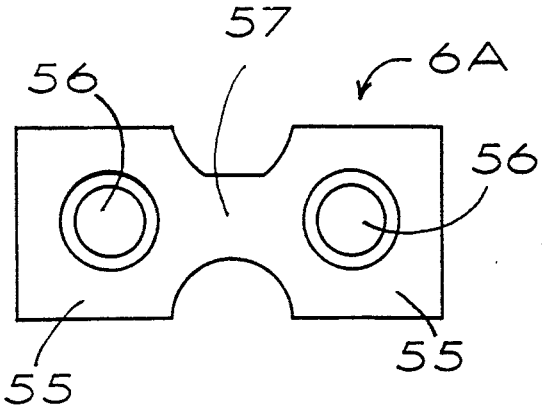
FIG. 10 is a plan view of a modified saddle.
Figure 11A:
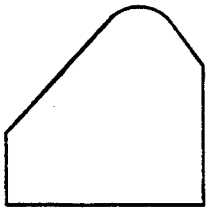
FIGS. 11A–11E show, in side view, various shapes of different embodiments of the saddle.
Figure 11B:
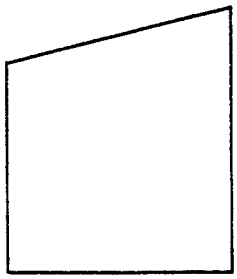
Figure 11C:
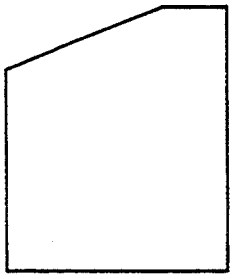
Figure 11D:
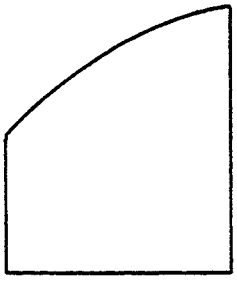
Figure 11E:
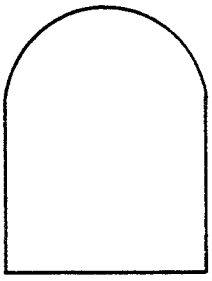

In the drawings, the saddles 6 have been shown as solid block-like elements. However, the saddles can be of different shape as for example shown in FIG. 10 where the saddle 6A is formed with side portions 55 with openings 56 for receiving bolts 15. The side portions 55 are connected by a narrower portion 57. In longitudinal section, the saddle can have a variety of different shapes as shown in FIGS. 11A–11E.

The essential requirement of the saddle is to establish a point of contact for the string at which the string can undergo change of angle and pass to the anchor point either directly in the case of a single point of contact for the string or to the rear wall of the platform in the case of the two point contact of the string.

Figure 13A:
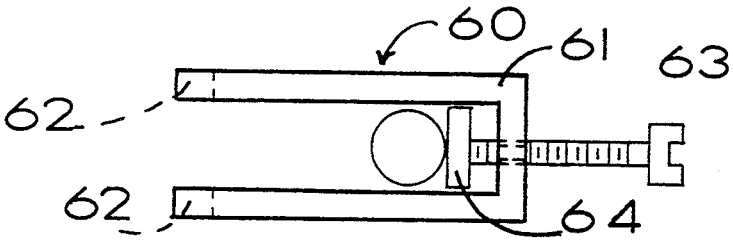
FIG. 13A is a side elevational view of a portable unit for longitudinally displacing the saddles.
Figure 13B:
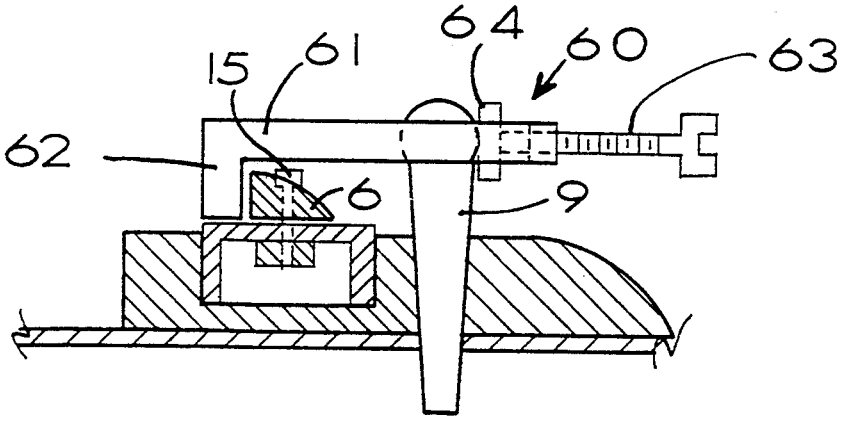
FIG. 13B is a top plan view of the portable unit in FIG. 13A.

In the embodiments which have been illustrated, the longitudinal adjustment of the saddles is effected by loosening the bolts 15 associated with each saddle so that the saddle can be longitudinally shifted by displacement of the bolts 15 in the slots 16. Because of the small size of the saddles 6, the use of finger pressure to displace the saddles is sometimes difficult and accordingly, an actuator in the form of a portable unit 60 can be employed as will be explained with reference to FIGS. 13A and 13B. The portable unit 60 includes a U-shaped frame 61 having depending legs 62 at the front of its free ends for abutting against the front or rear face of a saddle 6. At the rear of the frame 61, an adjusting bolt 63 is threadably engaged. The bolt 63 carries a bearing head 64 which can abut against bridge pin 9. In order to shift the saddle 6 longitudinally rearwards, the bolts 15 are loosened and the legs 62 are brought into abutment with the front face of the saddle. The adjustment bolt 63 is turned until bearing head 64 abuts against the bridge pin. Then while holding the frame 61, the adjustment screw 63 is turned further which will produce displacement of frame 61 and consequent displacement of saddle 6 therewith. When the desired position of the saddle has been reached, the bolts 15 are tightened to secure the saddle in its adjusted position. In order to shift the saddle longitudinally forwards, the depending legs 62 are brought to bear against the rear surface of the saddle instead of the front surface and the same operation is carried out except that the adjustment bolt 63 will now be rotated in the opposite direction so that the legs 62 will push the saddle longitudinally forwards as the adjustment bolt 63 is rotated. The operation is carried out relatively rapidly and the portable unit is transferred from saddle to saddle to carry out the string length fine tuning. Instead of a portable unit which acts on each saddle individually, a portable unit can be used which can act on all the saddles. Also, while the portable unit has been shown in combination with a bridge pin, it can be used in combination with other string anchoring means.

Figure 12:
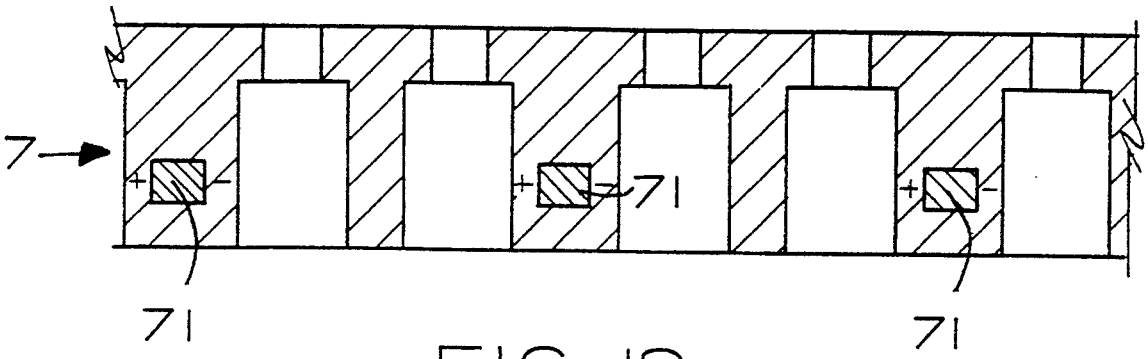
FIG. 12 is a transverse sectional view of a portion of the platform of FIG. 5 in which transducers are employed.

The bridge assembly can be adapted for an electrified acoustic guitar by providing transducer means between the saddles and the soundboard cover. In FIG. 12, transducers 71 are embedded in the platform 7 at locations directly beneath the saddles and the strings (not shown in FIG. 12). The transducers 71 are in the form of piezoelectric elements which transduce the vibrational energy into electrical signals which are fed to suitable amplification means and loudspeakers (not shown).

Figure 14:
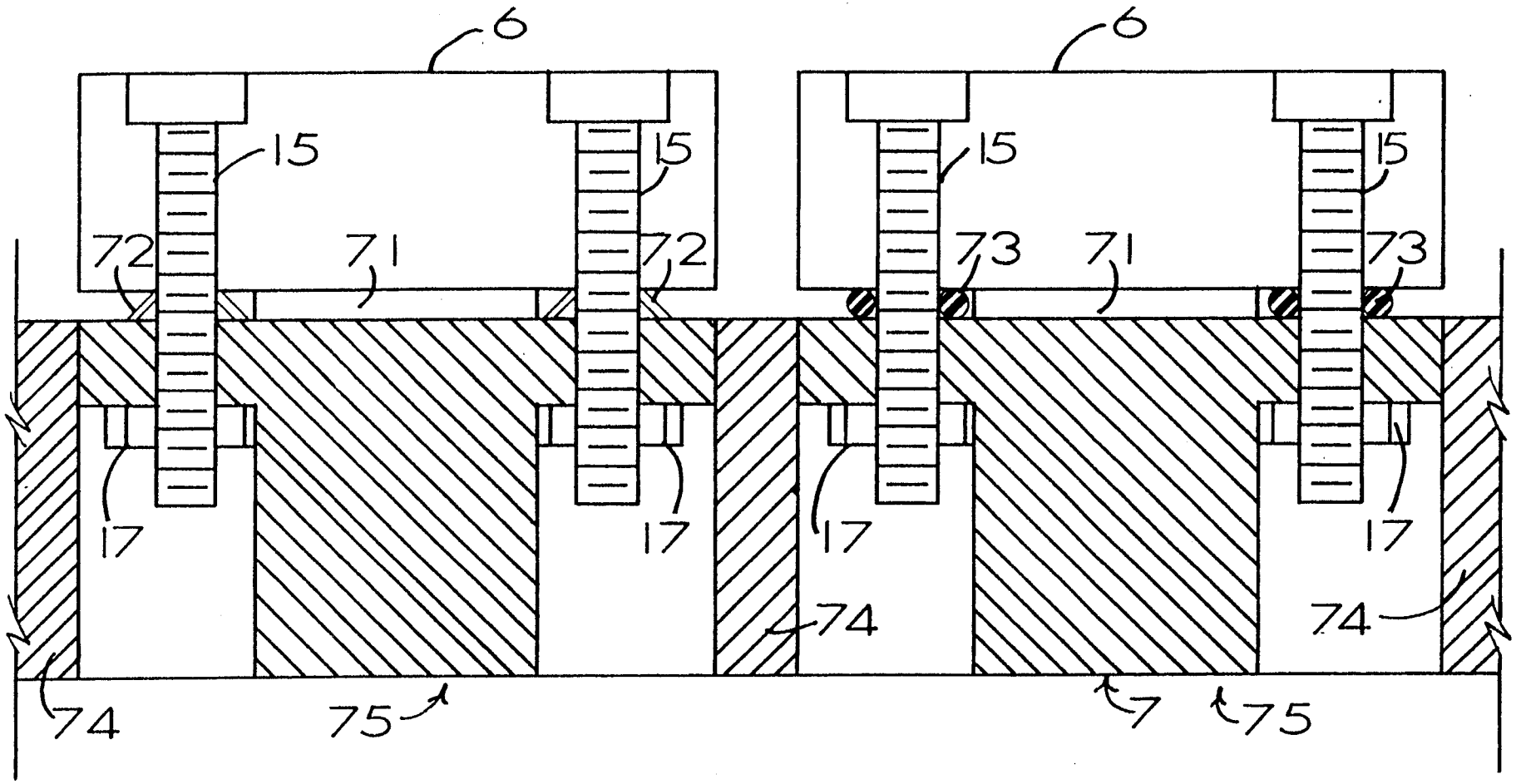
FIG. 14 is a transverse section on enlarged scale, showing a portion of a modified bridge assembly for an electrified acoustic guitar.

FIG. 14 shows a particularly advantageous embodiment of an adaptation of the bridge system for an electric acoustic guitar. In this embodiment, the transducers 71 are interposed between the lower surfaces of the saddles 6 and the upper surface of the platform 7. The transducers 71 are directly aligned with the points of contact of the strings with the saddles. The transducers extend beneath the saddles over an extent so that in all longitudinally adjusted positions of the saddles the transducers will be directly under and between the string contact point and the soundboard cover. When the bolts 15 are tightened to secure the saddles 6 on the platform 7, the transducers 71 are clamped between the saddles and the platform. It has been found that the degree of clamping force produced by the degree of tightening of the bolts 15 can affect the operation of the transducers 71 and it has been further found according to the invention that the variable effect on the transducers can be substantially eliminated by interposing a resilient means between the saddles and the platform. In a particularly effective embodiment shown at the left in FIG. 14, the resilient means is in the form of Belleville washers 72 between the saddles and the platform around each bolt 15. The Belleville washers provide resilient resistance to the clamping force produced by the combination of the bolt 15 and nut 17 and thereby prevent application of excessive clamping pressure against the transducers 71. In another embodiment shown at the right in FIG. 14, instead of Belleville washers, resilient O-rings 73 are employed. The resilient resistance in the connection of the saddles to the platform as provided by the washers 72 or O-rings 73, can be mounted between the head of bolt 15 and the saddle or between the head of bolt 15 and the saddle or between the nut 17 and the platform. The latter arrangements are effective because they allow the saddles to rest flush on the platform. The use of the resilient means in the connection of the saddles to the platform is also desirable when transducers are not utilized.

In order to isolate the vibrational energy and force applied by each string through its respective saddle to the soundboard cover, damping elements 74 are interposed in the platform 7 between adjacent saddles 6. The damping elements 74 serve as sound barriers and separate the vibrational energy applied by the strings to the saddles. The damping elements can be made of any suitable vibration damping material such as rubber, wood, etc. Effectively, the damping elements 74 subdivide the platform into successive sections 75.

Figure 15:
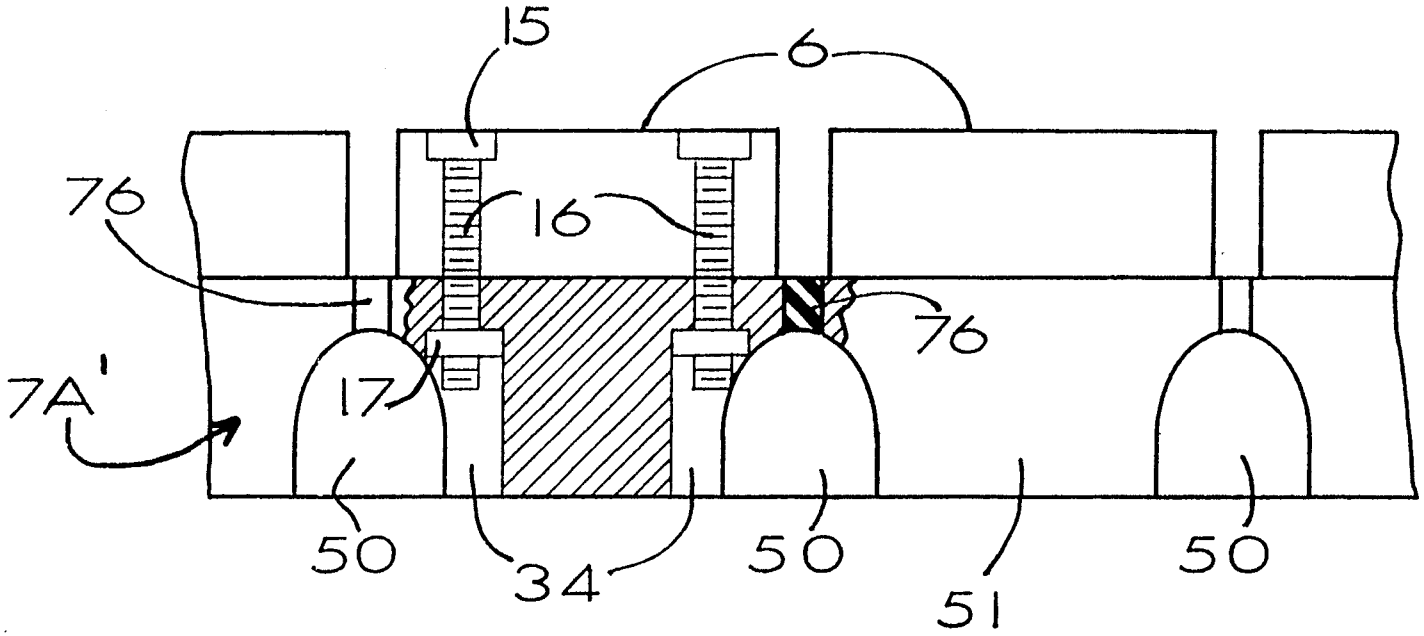
FIG. 15 is an end elevational view, partly broken away in section, of a portion of a modified platform of that in FIG. 4.

In the case of the embodiment of the platform provided with the longitudinal openings 50 as shown in FIG. 15, the damping members 76 are provided in the platform 7A' at the top of the openings 50 and do not extend to the lower surface of the platform as in the embodiment of FIG. 14.

The combination of the platform and saddles can be constituted as an assembly which can be retrofitted into an existing bridge by forming the groove 5 in the bridge to receive the assembly or alternatively, the platform and saddles can be produced as an assembly with bridge 4 for attachment to the soundboard cover.

Although the invention has been described in relation to specific embodiments thereof, it will become apparent to those skilled in the art that numerous modifications and variations can be made within the scope and spirit of the invention as defined in the attached claims.

What is claimed is:

1. A bridge assembly for a stringed musical instrument having adjustment for string length fine tuning, the musical instrument having a resonating box with a soundboard cover on which the bridge assembly is mounted, said bridge assembly comprising a bridge member fixed with respect to the soundboard cover, a block-like platform member secured to said bridge member, said bridge member including a portion of reduced thickness providing a relatively thin portion, said platform member including a lower portion supported by said thin portion of said bridge member, a saddle on which a string passes under tension, the contact of the string with the saddle providing a point of support for the string establishing a vibration length of the string, said string undergoing change of angle at said point of support to apply force thereat directed along a line of action passing through said platform and said thin portion of said bridge member to said soundboard cover and said resonating box, and means connecting the saddle to the platform member for adjustment of the saddle, longitudinally of the string, on the platform member to vary the vibration length of the string and thereby effect string length fine tuning, said means providing end positions for the longitudinal adjustment of the saddle at which, and for all positions therebetween, forces applied by the string to the bridge member will be directed to pass through said thin portion of the bridge member to said soundboard cover, said thin portion of the bridge member having an upper surface supporting said platform member, said upper surface being inclined relative to said soundboard cover at an angle related to the change of angle of the string at said point of support so that the force applied by the string to said point of support is directed substantially perpendicularly to said upper surface of the thin portion of the bridge member.

2. A bridge assembly as claimed in claim 1 wherein said platform member has an upper surface on which, said saddle travels during longitudinal adjustment, said upper surface of the platform extending substantially parallel to said soundboard cover in a longitudinal plane.

3. A bridge assembly as claimed in claim 2 wherein said string undergoes a change of angle of $\alpha$ at said point of contact, said upper surface of the bridge member being inclined relative to said sound board at an angle of $\alpha/2$.

4. A bridge assembly as claimed in claim 1 wherein said bridge assembly provides a second point of support for the string spaced longitudinally rearwards from the first said point of support, said string also undergoing change of angle at said second point of support.

5. A bridge assembly as claimed in claim 1 wherein said portion of reduced thickness in said bridge member is formed by a groove provided in said bridge member.

6. A bridge assembly as claimed in claim 5 wherein said platform member is tightly fitted in said groove, said saddle projecting out of said groove above an upper surface of said bridge member.

7. A bridge assembly as claimed in claim 1 wherein the musical instrument has a plurality of strings each supported by a respective said saddle, said platform member supporting the saddles in transversely spaced relation.

8. A bridge assembly as claimed in claim 7 wherein said lower portion of the platform member is provided with longitudinal openings in regions between adjacent transversely spaced saddles.

9. A bridge assembly as claimed in claim 8 wherein said platform member has a lower surface, said openings extending in said platform member to said lower surface to define posts between said openings, said posts being disposed beneath said strings and their respective saddles to transmit the forces from the strings to said thin portion of the bridge member.

10. A bridge assembly as claimed in claim 7 comprising sound transducer means operatively coupled between said saddles and said soundboard cover.

11. A bridge assembly as claimed in claim 9 wherein said posts rest on said upper surface of the bridge member.

12. A bridge assembly as claimed in claim 11 wherein said platform member has an upper I surface on which said saddles are supported which in a longitudinal plane extends substantially parallel to said soundboard cover.

13. A bridge assembly as claimed in claim 7 wherein said platform member includes a stepped surface supporting selected saddles at different levels above the soundboard cover.

14. A bridge assembly as claimed in claim 1 wherein said platform member includes a rear wall projecting upwardly on the platform member rearwards of the saddles so that the strings pass from the saddles onto said rear wall to make contact therewith at a second point of support whereat the strings undergo change of angle and apply forces to said rear wall, and anchor means for the strings rearwards of said rear wall, said rear wall being configured so that the forces produced by the change of angle of the strings at said second points of support are directed along a line of action passing through said thin portion of said bridge member.

15. A bridge assembly as claimed in claim 14 wherein said rear wall has a transverse curvature, said platform member having steps at different levels supporting respective saddles at a determined height projecting above said rear wall.

16. A bridge assembly as claimed in claim 14 wherein said bridge member has groove means therein rearwards of said rear wall to permit free passage of the strings from said rear wall to said anchor means.

17. A bridge assembly as claimed in claim 7 wherein said means for longitudinal adjustment of said saddles relative to the respective strings comprises releasable securing means between the saddles and the platform member and an actuator for displacing the saddles longitudinally when the releasable securing means releases the saddles from the platform member.

18. A bridge assembly as claimed in claim 17 wherein said actuator comprises a portable unit engageable with the bridge assembly and including adjustment means for engaging respective saddles to displace the same longitudinally.

19. A bridge assembly as claimed in claim 18 further comprising anchor means for said strings disposed rearwards of said saddles for securing the strings relative to the soundboard cover, said portable unit including means engageable with said anchor means and carrying said adjustment means.

20. A bridge assembly as claimed in claim 19 wherein said portable unit includes a frame comprising abutment means engageable with said saddles, said actuator further comprising a rotatable threaded member threadably engaged with said frame to abut against said anchor means such that upon rotation of said threaded member the frame is longitudinally displaced to cause the abutment means to displace the saddles accordingly.

21. A bridge assembly as claimed in claim 9 comprising vibration damping means in said platform member between adjacent posts.

22. A bridge assembly as claimed in claim i wherein said means connecting the saddle to the platform comprises a resilient connection.

23. A bridge assembly for a stringed musical instrument having adjustment for string length fine tuning, the musical instrument having a resonating box with a soundboard cover on which the bridge assembly is mounted, said bridge assembly comprising a bridge member fixed with respect to the soundboard cover, said bridge member having a cut-out extending therethrough, a block-like platform member secured in said cut-out in said bridge member and resting on said soundboard cover, a saddle on which a string passes under tension, the contact of the string with the saddle providing a point of support for the string establishing a vibration length of the string, said string undergoing change of angle at said point of support to apply force thereat directed along a line of action passing through said platform member directly to said soundboard cover and said resonating box, and means connecting the saddle to the platform member for adjustment of the saddle, longitudinally of the string, on the platform member to vary the vibration length of the string and thereby effect string length fine tuning, said means providing end positions for the longitudinal adjustment of the saddle at which, and for all positions therebetween, forces applied by the string to the saddle will be directed to pass through the platform directly to said sound board cover.

24. A bridge assembly as claimed in claim 23 wherein said bridge member has a rear surface bounding said cut-out at the. rear thereof, said platform member bearing against said rear surface of said bridge member.

25. A bridge assembly as claimed in claim 23 wherein the musical instrument has a plurality of strings each supported by a respective said saddle, said platform member supporting the saddles in transversely spaced relation.

26. A bridge assembly for an electrified, acoustic stringed musical instrument having adjustment for string length fine tuning, the musical instrument having a resonating box with a soundboard cover on which the bridge assembly is mounted, said bridge assembly comprising a bridge member fixed with respect to the sound board cover, a block-like platform member secured to said bridge member, a plurality of saddles on which respective strings of the instrument pass under tension, the contact of the strings with the saddles providing points of support for the strings establishing vibration lengths of the strings, means connecting the saddles to the platform member for adjustment of the saddles, longitudinally of the strings, on the platform member to vary the vibration lengths of the strings and thereby effect string length fine tuning, transducer means interposed between each saddle and the platform member for producing electrical signals corresponding to vibrational energy transmitted from the strings to the saddles, and adjustable clamping means clampingly attaching the saddles to the platform member, said adjustable clamping means comprising resilient means resiliently resisting clamping pressure of the saddles and the platform member on said transducer means.

27. A bridge assembly as claimed in claim 26 wherein said adjustable clamping means comprises a threaded connection between each saddle and the platform member, said resilient means comprising a resilient member in each threaded connection.

* * * * *